US005518235A

United States Patent [19]

Mendenhall

[11] Patent Number: 5,518,235

[45] Date of Patent: May 21, 1996

[54] GOLF CLUB HEAD

[76] Inventor: Byron R. Mendenhall, 6233 Napoli Ct., Long Beach, Calif. 90803

[21] Appl. No.: 262,246

[22] Filed: Jun. 20, 1994

[51] Int. Cl.[6] ..... A63B 53/02

[52] U.S. Cl. ..... 473/314; 473/324; 473/350

[58] Field of Search ..... 273/167 R, 167 D, 273/167 F, 167 G, 168, 169, 164.1, 80 C, 80.1, 80.2, 80.3, 80.4, 79, 167 H; D. 21/217, 218

[56] References Cited

U.S. PATENT DOCUMENTS

| | | | |
|---|---|---|---|
| D. 216,031 | 11/1969 | Blake | 273/80 C |
| 922,444 | 5/1909 | Youds | 273/169 |
| 1,705,250 | 3/1929 | Hincks | 273/167 G |
| 3,035,839 | 5/1962 | Coglianese | 273/164.1 |
| 3,194,564 | 7/1965 | Swan | 273/164.1 |
| 3,539,184 | 11/1970 | Koorland | 273/167 G |
| 3,815,910 | 6/1974 | Raines | 273/80 C |
| 3,967,826 | 7/1976 | Judice | 273/80 C |
| 3,980,301 | 9/1976 | Smith | 273/80 C |
| 4,136,877 | 1/1979 | Antonious | 273/164.1 |
| 4,650,191 | 3/1987 | Mills | 273/164.1 |
| 4,693,478 | 9/1987 | Long | 273/80 C |
| 4,938,470 | 7/1990 | Antonious | 273/164.1 |
| 4,955,610 | 9/1990 | Creighton | 273/80 C |

FOREIGN PATENT DOCUMENTS

| | | | |
|---|---|---|---|
| 14169 | 8/1898 | United Kingdom | 273/169 |

*Primary Examiner*—Sebastiano Passaniti
*Attorney, Agent, or Firm*—Knobbe, Martens, Olson & Bear

[57] ABSTRACT

The present invention provides greater stability and control by a golfer in hitting a golf ball. A novel "front to back" configuration of the hosel to the head of a golf club enhances the golfer's visual alignment prior to the stroke, provides better control of the point of impact with the ball and its resultant trajectory, and reduces the torsional force transmitted to the shaft. Thus, the ball is more precisely maneuvered over the golf course and the golfer's performance is improved.

13 Claims, 4 Drawing Sheets

GOLF CLUB HEAD

BACKGROUND OF THE INVENTION

The present invention relates to a novel design for golf equipment, and more particularly to a golf club head with an improved configuration which affords greater stability and control by the golfer.

The history of golf can be traced to Scotland, where the first recorded games occurred in the fifteenth century. There is evidence that there may have been a Dutch antecedent to the game that evolved in Scotland. Codified rules for playing golf have existed since the mid-eighteenth century.

Today, the sport of golf provides a challenging diversion for people around the world, of all ages. It is chosen by many because performance and success are not solely dependent upon strength, but in addition require experience, discipline, and control. This is evidenced by the triumph of older golfers over younger ones in tournament and social play. That is, while sheer brawn can enable a golfer to hit or "drive" the golf ball the long distances traversed during a game, equipment is available today to help compensate for a lack of great physical strength by the golfer. Thus, the present day golfer does not require a powerful "swing" for success but must rely more on strategy and practiced control.

The object of golf is to use a "club" to hit a golf ball from the "teeing" area into a hole or "cup" located in a "putting" area which is several hundred yards away. In the U.S., the ball is 1.68" in diameter, and the hole has a cylindrical shape that is 4¼" in diameter and at least 4" deep. Each segment composed of a teeing and putting area is also commonly referred to as a "hole", and a game or "round" may include either nine or eighteen holes.

A golf course typically consists of grassy areas for teeing and putting, and grassy areas along the "fairway". "Hazards" comprised of water and/or sand serve to challenge the golfer and are also located along the fairway. The winner of a game, or a tournament involving several games, is the golfer who manages to finish using the fewest "strokes" of his or her clubs. The proper "form" for golfing is generally comprised of 1) proper "addressing" or alignment of the ball with the club, 2) a full back- and through swing to gain club speed, and 3) precise, square impact of the ball with the "head" of the golf club.

The trajectory or path of the golf ball is determined by both the momentum of and the point of contact with the club head. Except when hitting out of a sand trap, the club head and ball make direct contact. A vector is formed by the initial direction and speed of the golf ball and results from the ball's contact with the front "face" of the head. It is this vector which must be precisely controlled by the golfer for accurate placement of the ball toward the cup. From the teeing area, it is desirable to control the ball so that it stays on the open fairway and avoids any hazards. Control in putting is especially important in order to get the ball to follow the "line", which is the correct path to the cup from an initial lie or position, and depends on the condition of the playing surface. Ideally in putting, the golfer only needs to provide an initial rolling motion of the ball along the line and it will follow the line into the cup.

A golfer requires a basic set of clubs for the various situations he or she will usually encounter. The basic assortment of golf clubs required to play a game includes the broad classifications of "drivers", "irons", and "putters". The purpose of each type of club is to provide a specific initial angle for the trajectory of the ball, in addition to providing enough energy to achieve a specific distance. Drivers are used to hit the ball the longest distances, hopefully without veering far off the fairway or encountering a hazard. Irons are used to control a golf ball with more vertical than horizontal travel, possibly to clear a hazard, and gain a more advantageous position on the grassy fairway or putting green. Putters are used once on the putting green either for an "approach shot" to get close to the cup or to "hole-out" by landing the ball into the cup and finishing that hole.

Today's golf clubs can vary widely in design. Generally, however, all clubs are comprised of portions referred to, from top to bottom, as the grip or handle, the shaft, and the head. The handle is formed by wrapping leather, rubber, or other synthetic material to encase the gripping end of the shaft, which is held by the golfer. The other end of the long, thin, tubular shaft is attached to the head. The shaft may be stainless steel or a graphite composite, and it may be longer or shorter for specific distance or range control. The basic types of clubs can generally be identified by their head design and shaft length.

Originally, club heads, as well as shafts, were made of wood. Today, although a few wood heads are still available, club heads are usually made of metal. The head or club types may be grouped as irons, "woods" and "metal woods", and putters. Generally, drivers for the 200 yard and greater range are woods and metal woods, and wedges and drivers for shorter ranges are irons. A "ferrule" portion may be located above the "hosel", or neck portion of the head, on the shaft of irons. The ferrule is a short, decorative, sleeve-like cap. Woods may include "whipping" above the hosel. The whipping is formed by thin laces of leather or other material which are wrapped around the shaft numerous times.

In the construction of a golf club, the hosel has a socket into which the shaft is inserted and secured. The hosel is often formed integrally with the head and is contiguous with the "heel" or proximal end of the head. The hosel may also be formed as a separate portion attached to the top of the head and aligned above the heel. Thus, the shaft and hosel are traditionally in a "top to bottom" configuration with the head. That is, the shaft, hosel, and club head are generally vertically aligned, with the golfer effectively "pushing" the club head through the stroke.

The axis of the shaft may be collinear with the hosel and thus behind the front face. Or, in the case of putters, the shaft may be slightly displaced in front of the face. In the latter case, the hosel is angled below the socket and goes down into the top of the head above the heel, yielding essentially the same top to bottom configuration. This slight displacement of the shaft to a location in front of the face does result in a "line of sight" which allows somewhat more accurate positioning of the club by the golfer. However, the shaft axis is still generally positioned between the center of the ball and the face of the club.

The face of the club head is intended to hit the golf ball. A golfer who hits the ball with the hosel of the head, instead of the face, is said to "shank" the ball, which results in a wild, uncontrolled golf shot. The face may have a pattern of grooves to reduce possible rolling contact with the ball. Also, the face may be marked or painted to note the area of the "sweet spot", which is centrally located. This area is called the sweet spot since it is the ideal location for imparting the desired momentum or energy to the ball. The sweet spot generally marks the center of mass for the club head and can vary from a small to a major portion of the face.

Another part of the club head is the "sole", which is the bottom surface. The sole may be of varying area, depending on the head design. The sole for a driver is often of a convex shape, to minimize contact of the head with the ground during the stroke, since this can change the momentum imparted to the ball. The sole for a blade-shaped putter is substantially narrower and of smaller total area.

The back portion of the head, behind the face and above the sole, can be thick and bulbous or thin and narrow. The former is characteristic of woods and metal woods. The latter is characteristic of irons and putters. The backs of irons and putters may also be formed of "struts" and "cavities" which form hollow areas and reduce the total mass at the back of the head. In recent designs, "peripheral weighting" is used to concentrate the head's mass around the face, which results in a back portion that may be either recessed or made bulky by using a lightweight "filler" medium.

The last part of the head is the "toe" or the end of the head opposite the heel. The toe end is sometimes referred to as the "nose". This end will be referred to herein as the distal end of the head.

In golf, energy is transferred to the ball by the momentum of the club, and specifically by the club head's momentum. Linear momentum is derived as an object's mass multiplied by its velocity ($P=m\times V$). Linear or tangential velocity at a point on a curve is found from the angular speed and the radius at that point ($V=\omega\times r$). The maximum momentum ($P=m\times\omega\times r$) or energy for driving long distances is achieved by using a club with a large head (m) on a long shaft (r) along with a full "backswing" and downswing ($\omega$). Alternately, for shorter distances, a smaller head and/or shorter shaft is used, sometimes with smaller swinging movements. A putter head may be either "blade" or "mallet" shaped, although still of smaller overall mass and dimension than the head of a driver.

Golf clubs are further distinguished by the "lie" and the "loft" of the club head. The lie is the angle formed by the shaft and hosel with the horizon. Typically, as the lie gets smaller, the shaft of the club gets longer to allow a wider swing path and thus greater velocity. The loft is the angle formed by the face of the head with the vertical, where the vertical is defined herein as perpendicular to the horizon. A greater loft corresponds to greater vertical, rather than horizontal, travel of the ball.

For example, a putter will generally have a relatively short shaft, and the putter head will have close to a 90 degree or "upright" lie and a nearly zero degree or "straightfaced" loft. These specifications help to impart a controlled, horizontal force to the ball, as is desirable for putting. Alternately, drivers and irons are designed to have longer shafts and heads with smaller lies. Also, these heads have lofts ranging from approximately 8 degrees to up to 60 degrees, all of which help to deliver an upward force to the ball and make it airborne for a majority of its travel.

As mentioned above, there are existing designs for clubs which enhance the total energy delivered by the golfer's backswing, downswing, and "followthrough". These clubs provide delivery of the golf ball over two hundred yards by enlarging the head's mass and also the available sweet spot on the head. However, there are few club designs which attempt to improve the golfer's control over his or her stroke and the ball. This control is particularly important for putting, where the final, short distance must be carefully navigated in order to place the ball at least near, if not in, the cup. Thus, there is a need to provide equipment which improves the golfer's control over the trajectory of the ball.

SUMMARY OF THE INVENTION

The present invention provides greater stability and control by a golfer in hitting a golf ball. A novel "front to back" configuration of the hosel to the head of the golf club provides three advantages: 1) enhanced visual alignment prior to the stroke, 2) better control over the point of contact with the ball and its resultant trajectory, and 3) reduced torsional force on the hosel and shaft at impact. The innovation of the present invention places the hosel on the front face of the head, which in one embodiment is a putter; although, the principles of the present invention also apply to other clubs as well.

This front to back configuration results in a generally horizontal alignment of the connection between the hosel and the club head. It assures that the shaft at that location will be ahead of the ball, such that the golfer has the feel of "pulling" the ball through the stroke. Thus, this configuration affords greater control of the club head by the golfer. Improved control also results from a hosel to head connection which is closer to the sweet spot (that is, located closer to the center of mass), and therefore requires less hand-eye "compensation" by the golfer in executing contact with the ball at the sweet spot. This configuration also provides for the use of less material at the hosel connection point, thereby allowing a thin-face construction to improve the "feel" of the club, and to allow the concentration of weight around the sweet spot. Thus, the sweet spot is advantageously enlarged.

While club heads are currently available which have hosels that align the axis of the shaft in slightly front of the face, these hosels are still conventionally located in the top to bottom configuration described previously. These conventional hosels allow neither as precise a pre-stroke alignment over the center of the ball nor the preferably "pulling" of the club head through the stroke, both of which are afforded by the present invention.

In a preferred embodiment, a putter head of the present invention includes a hosel located on its face near the proximal end. The hosel has a cylindrically shaped socket at its uppermost end that is angled to provide a nearly upright lie of 76 degrees. The socket shape corresponds to the conventional tubular shape of the typical shaft and may alternately have an outer squared shape or other design. The centerline of the socket is located 0.84" from the face, or half the diameter of a golf ball. This provides exact prestroke alignment over the center of the ball.

The putter head is nearly straightfaced, with a loft of three degrees. The head is five inches long from its heel to its toe, or from its proximal to distal end. The head is 1¾" at the widest part, measured from the face edge to the back edge of the sole. The height of the head, which is the maximum distance from the top edge to the bottom edge of the face, is one inch.

The back portion of the head is formed of three struts with two cavities formed between. The cavities are generally rectangular hollows formed behind the face and above the sole. Although, the specific shape of the hollows, if any, is not important to the present invention. The center strut has a notch on its top surface at the front edge, located halfway from the heel to the toe, to mark the sweet spot. This notch is a visual aid for the golfer and could instead be a painted design on the top of the club head. In alternate embodiments, the overall design of the club head may be of more blade-like or mallet shaped construction. The head may be constructed with or without a mark for the sweet spot, and with or without a grooved face.

The sole is generally convex. The heel and toe ends are uplifted a maximum of 3/16" from the horizon under the proximal and distal struts, respectively. The sole then extends downward to the ground from each end toward the center. The larger central area of the sole is formed below both cavities and the center strut. In the instant case, this central area forms a plane that is parallel to the horizon, although an alternate design may angle the sole behind the front face, upward toward the back.

In the preferred embodiment, the heel or proximal strut contains a hole extending laterally through for attachment of the hosel, which attaches through the front face. The hole may extend either partly or completely through the head. The portion of the hosel contained in the strut provides the contacting area for pulling the head. In an alternate embodiment, the hosel may be integrally formed with the head, yet is still located at the face area adjacent the proximal strut. A portion of the face and heel extends around the hosel to form the most proximal end of the head. The location of this portion around the hosel results from the hosel's proximity to the sweet spot, and also serves to increase the effective mass behind the hosel which is pulled into contact with the ball.

In the preferred embodiment, the major portion of the hosel extending below the socket is of substantially rectangular cross-section; although, other cross-sectional designs may be substituted. The hosel is angled below the socket to form a segment extending toward the putter face. It has an axis that is parallel to the horizon. The hosel is then angled to extend vertically downward. This segment defines the main axis of the hosel and is positioned in front of the face.

Next, the hosel is angled 45 degrees from the vertical, or, equally, 45 degrees from the horizon. The hosel extends downward along this angle until it is in communication with the face of the head. In the previous hosels, the main axis is vertical and is in direct communication with the top of the head. The hosel of the present invention is in communication with the face of the head approximately ¼" above the lowest point of the bottom edge of the face. Alternate embodiments of the present invention may utilize different angles and segment lengths to achieve this front to back configuration of the hosel to the head; although, the angle of contact of the hosel at the face is preferably greater than zero degrees.

In the present invention, the hosel segments between the angles are not so long as to weaken the construction by creating large moment arms. However, in order to afford a similar alignment with the center of the golf ball, conventional hosels would require an extended segment length below the socket. This would create a large moment arm around the shaft attachment and contribute to structural stress at the angled portions.

During play, the golfer's line of sight resulting from the present invention allows more accurate positioning than the previous designs, which in turn allows contact of the golf ball at the very bottom of the downswing. In the hosel of the present invention, unlike previous designs, the center of the golf ball can be exactly aligned with the shaft in terms of distance from the face. The ball is still located distal to the hosel and shaft. However, the hosel is located much closer than before to the sweet spot.

The present invention has the hosel located below the intended point of contact by the ball on the face, while the previous putter designs all locate the hosel above this point. This locates the hosel's mass closer to the sweet spot of the club head and contributes to the golfer's improved control. Also, the front to back configuration provides the golfer with the feeling of pulling the club head toward the ball, rather than pushing the head. This results in a more comfortable and controllable stroke.

Further, it is known that the maximum force, and momentum, that can be delivered to the ball occurs at the bottommost point of the golfer's swing. Since the force is acting on a curved surface (the golf ball) and is a vector quantity, it is resolved into tangential and radial components at the point of impact on the surface. In the present invention, the putter face is vertically positioned upon contact with the back of the ball. This results in a purely radial, or horizontal, force vector acting on the ball. This is the ideal situation to best control the motion of the ball and to have it follow the intended line.

In an alternate club embodiment, such as a driver instead of a putter, there also is improved line of sight and control afforded by the front to back configuration. The direction of the force, and the angle of the resultant airborne trajectory of the ball, is further accomplished by choosing a driver having the desired loft. The proper choice of club, in all cases, will result in the desired angle and distance if precise pre-stroke alignment, adequate head velocity, and accurate point of impact with the ball are executed.

In addition, a golfer is more likely to have the club raised slightly off the ground at the time of contact with the ball, except in sand, to avoid "drag" caused by contacting the ground before the ball. Thus, the actual point of contact is closer to the hosel and shaft of the present invention than to the hosel and shaft of previous designs. The ball is also more likely to be contacted squarely from behind by the present invention, rather than from slightly above or below. This affords additional control by the golfer of the applied force on the ball and helps to minimize any undesirable "spin" on the ball. Unwanted spin can inconveniently alter the ball's trajectory and can occur by not hitting the ball squarely at the desired point and/or by prolonged contact that can impart rotation.

When a ball is hit, a reaction force by the ball is applied to the club head, and twisting at the hosel/shaft junction may occur. The previous club designs attach the hosel to the top of the head, and torsional forces are directly transmitted to the hosel and shaft. The twisting of the head that results means that there is reduced control over the magnitude and direction of the force on the ball. Also, this contributes to material fatigue of the hosel and shaft and may cause premature retirement of the club, which can be expensive to replace.

The torsional force or moment is formed by the reaction (inertial) force of the ball multiplied by a distance ($M=F\times d$). The distance is measured along a line from the point of application to the point of reference. The force vector is the force component normal to this line. The moment is also a vector quantity which takes its direction from the component force vector and acts around the reference point. In the instant case, the reference is the part of the hosel axis in contact with the head. Ideally, when putting the force is perpendicular to the club face.

In the present invention, the front to back configuration results in reduced twisting. The reduction is due largely to the fact that the hosel is located closer to the actual point of impact with the ball. The axis of each of the previous putter hosel designs is formed on the most proximal end of the club head and thus transmits the maximum torsional force to the shaft. In the preferred embodiment, the hosel portion that is located within the proximal strut forms an arm that not only provides the feeling of pulling the club head, but also opposes the moment caused by the ball and further minimizes transmittal of the torsional force.

The front to back configuration of the present invention thus provides improved stability and control by a golfer. The location of the hosel on the face results in the feeling of pulling, not pushing, the club head. While the present invention is described in detail below for a preferred putter design, similar improvement in control can be found in application of this design to other putter designs as well as to other club types, such as drivers. Further advantages and applications of the present invention will become apparent to those skilled in the art from the following detailed description and the drawings referenced herein.

DETAILED DESCRIPTION OF THE INVENTION

Figure 1:
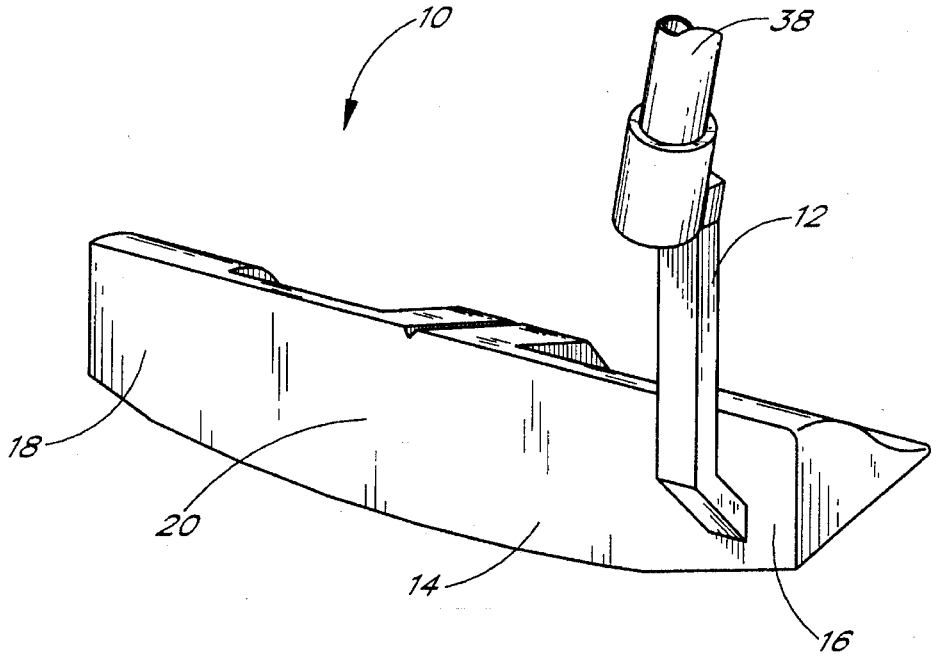
FIG. 1 is a perspective view of the preferred embodiment showing the front face of the club head.

Referring now in detail to the drawings, FIG. 1 shows a perspective view of a preferred embodiment of the present invention. The club head for a putter, generally referenced by the numeral 10, is shown. The hosel 12 of the present invention is located on the front face 14 of the head 10, and thereby forms a front to back configuration of the hosel 12 to the head 10.

Figure 2:
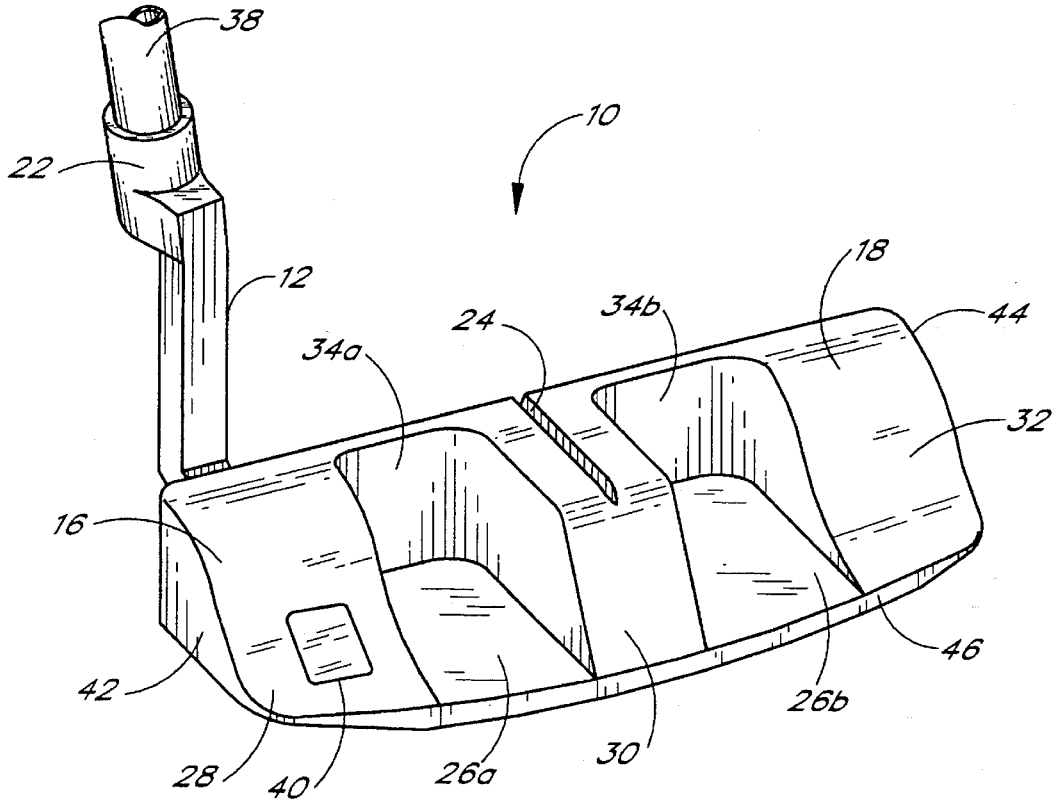
FIG. 2 is a perspective view of the preferred embodiment showing the back of the club head.
Figure 3:
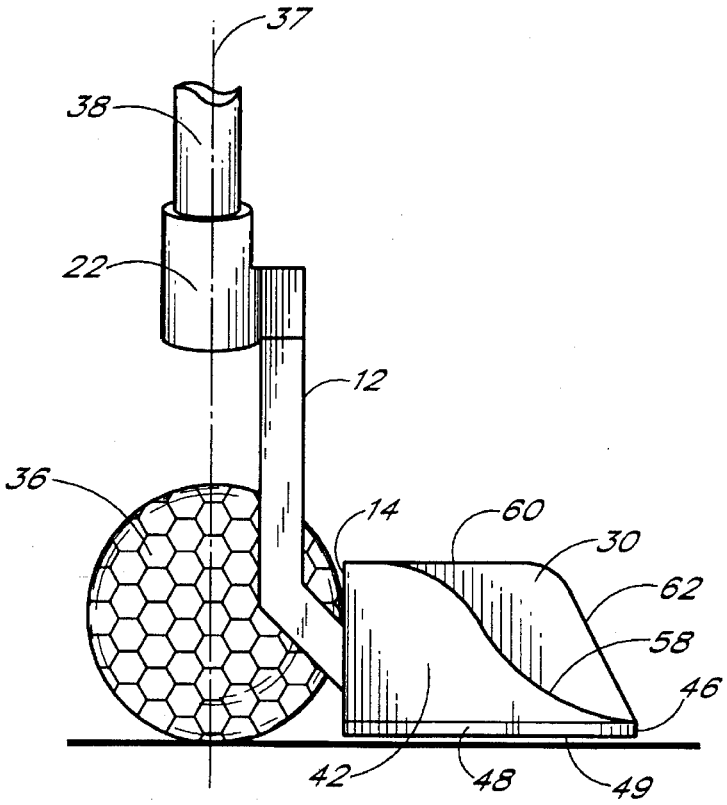
FIG. 3 is an illustration of the alignment of the golf club afforded by the present invention, wherein the center of the ball is in line with the axis of the club shaft.

One advantage of this configuration, shown clearly in FIG. 3, is that it provides greater control by pulling the head 10 rather than pushing it toward the ball. Another advantage of the present invention can be seen in FIGS. 1 and 2 in the placement of the hosel 12, to a position removed from the proximal face 42, closer to the sweet spot 20. Also, since the hosel 12 is located lower than the previous designs which attach to the top of the head 10, control of the head 10 is further improved. This is due to the hosel 12 position which is closer to the center of mass of the head 10, both in regard to a more distal location as well as to a more bottom location on the face 14. In addition, as was previously described in greater detail, in most situations a golfer will strive to keep the head 10 slightly off the ground upon impact with the ball 36, rather than lose momentum due to contact with the ground prior to contacting the ball 36.

Referring to FIG. 1, the heel 16, or proximal end, of the head 10 extends to the right of the hosel 12. The hosel 12 is not contiguous with the most proximal end of the head 10. The toe 18, or distal end, of the head 10 is shown to the left of the hosel 12.

The construction of the hosel 12 is more clearly seen in FIG. 2, where the view is the result of rotating the toe 18 of FIG. 1 in a clockwise manner around the hosel 12. As shown in FIG. 2, the hosel 12 of the preferred embodiment extends through the heel 16. The socket 22, located on the uppermost end of the hosel 12, is angled to provide the appropriate lie or angle with the horizon. Ideally, the head 10 strikes a golf ball 36 at the sweet spot 20 of the face 14, which is generally located below the notch 24 on the top of the club head 10.

In the preferred embodiment, the back portion of the putter head 10 is comprised of a generally rectangular hollows or cavities 26, formed between strut portions 28, 30, and 32. As more clearly illustrated in FIGS. 2 and 4, the hosel 12 is adjacent the proximal strut 28, which forms the heel 16 of the head 10. The notch 24 is located on top of the central strut 30. The toe 18 of the head 10 is formed by the distal strut 32.

In the preferred embodiment, the hosel 12 contains a portion which extends laterally through the head 10, as shown in FIG. 2. As will be discussed in greater detail below, the extension of the hosel 12 continues at least partly through the head 10, and the longitudinal axis of this portion of the hosel 12 is substantially parallel to the horizon.

Referring now to FIG. 3, the lower portion of a golf club is shown to illustrate an ideal alignment of the golf ball 36 prior to the putting stroke. The view is of the proximal end of the head 10 and ball 36, such as a spectator might have from behind the golfer's shoes. When the face 14 is in contact with the ball 36, a parallel plane (not shown) is formed by the center of the ball 36 and the line 37 along the collinear axes of the socket 22 and the club shaft 38. In the preferred embodiment, the distance from this parallel plane to the face 14 is 0.84". This corresponds to precisely half the diameter of the golf ball 36, which is 1.68". Thus, although the golf ball 36, at the sweet spot 20, is located distal to the location of the hosel 12 on the face 14, the center of the golf ball 36 aligns generally with the axis of the shaft 38.

In alternate embodiments, the location of the longitudinal axes of the shaft 38 and the socket 22 can be maintained with the center of the golf ball 36 through appropriate lengths of the lower segments 50, 52, 54 of the hosel 12. For other club types, such as drivers (not shown), the face 14 would be lofted appropriately. This lofting would then be shown in FIG. 3 by the face 14 tilted to an angle with the vertical. Thus, during the pre-stroke alignment by the golfer, the center of the ball 36 is still lined up with the shaft 38, even though the face 14 and sweet spot 20 may be located at an angle to, and not parallel with, the line 37.

Figure 4:
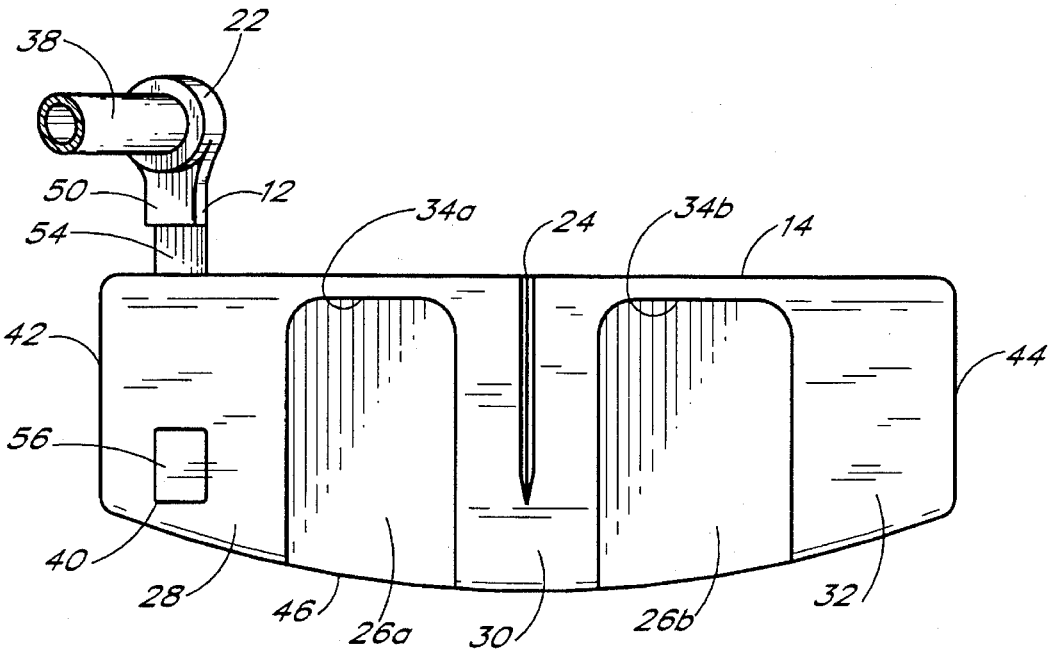
FIG. 4 is a top plan view of the preferred embodiment of a putter head showing the hosel attachment to the face.

Referring now in detail to FIG. 4, the top view of the putter head 10 in the preferred embodiment of the present invention includes cavities 26 of generally rectangular shape. These cavities 26 serve to reduce the total mass of the putter head 10. In alternate embodiments, other shapes of the cavities 26 may be utilized, or the putter head 10 may be of a more blade-like shape, wherein the general back portion comprised of the struts 28, 30, and 32 and cavities 26 may be replaced by a single, narrower portion. Alternately, there may be one cavity 26 or more than two such cavities 26 comprising the back portion.

As shown in FIG. 4, the socket 22 is of a cylindrical shape, and the remaining portion of the hosel 12 is of substantially rectangular cross-section. The hosel 12 enters from the face 14 of the head 10 into a rectangular aperture 40 in the heel 16, continuing through the proximal strut 28 of the head 10. In the preferred embodiment, the heel 16 and toe 18 have end faces 42 and 44, respectively, which are parallel to one another and at right angles to the face 14. The back edge 46 of the head 10 is of a convex shape. Again, the overall shape and dimension of the head 10 may be replaced by a more mallet or blade-like body.

Figure 5:
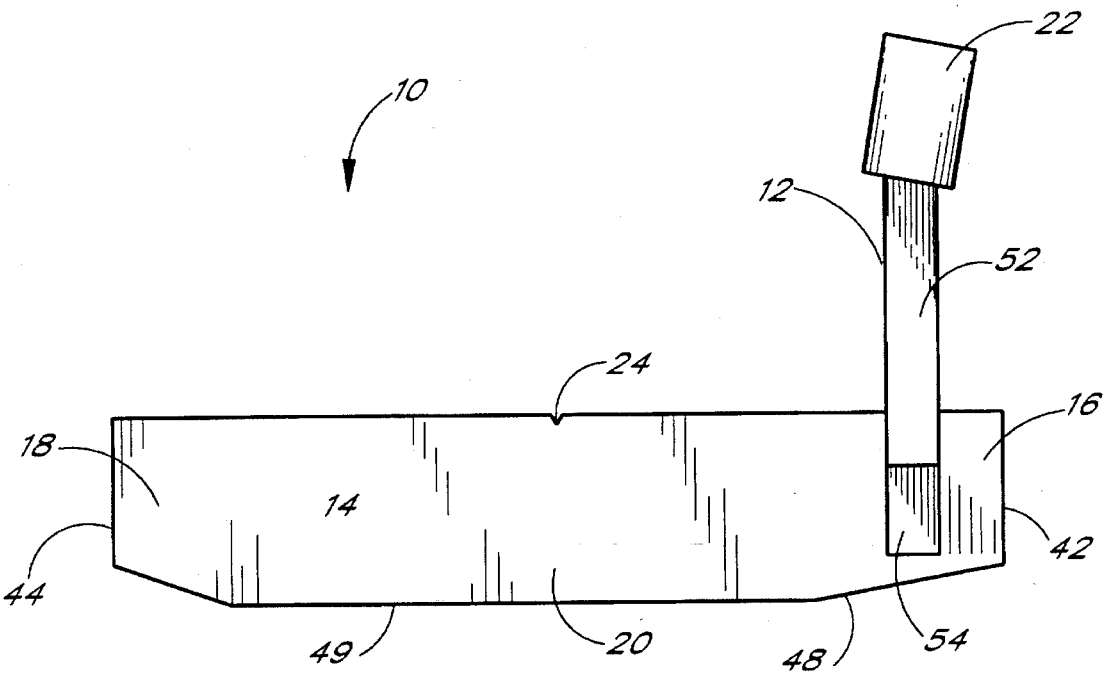
FIG. 5 is a front elevational view of the preferred embodiment showing the hosel placement on the face.
Figure 6:
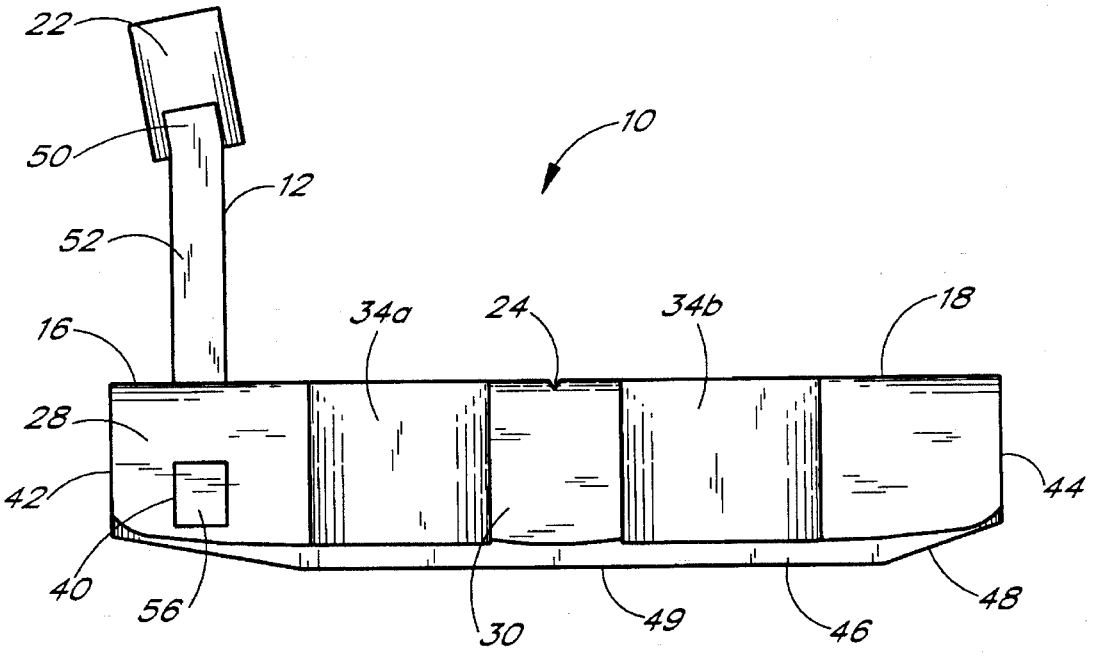
FIG. 6 is a back elevational view of the preferred embodiment showing the lie of the putter head.

As shown more clearly in FIGS. 5 and 6, the bottom of the head 10, referred to as the sole 48, is of a generally convex shape. As shown in FIG. 5, the lowermost or central portion of the sole 48 is located between the heel 16 and toe 18, and includes the general location of the sweet spot 20. Although the notch 24 is shown formed of a V shape extending ⅛" down into the top of the central strut 30, other methods of marking the sweet spot 20 may be employed, such as a simple painted line.

Referring now to FIG. 6, the lie of the head 10 in the preferred embodiment is 74 degrees from the horizon, or 16 degrees from the vertical. The distance from the outermost point of the socket 22 to the face 14 is approximately ⅛" The outer diameter of the socket 22 is approximately ½". The socket 22 is ¾" in length, with the opening for the shaft 38 provided substantially along the length. The cross-section of the hosel 12 extending between the socket 22 and the face 14 is approximately ⅓"×¼". The portion of the hosel 12 extending below the socket 22 to a point near the top edge of the face 14 is approximately 1¼". The hosel 12 further extends ¾" and is attached at the head 10 approximately ¼" above the plane 49 formed by the central portion of the sole 48. The plane 49 is perpendicular to the face 14 and parallel to the horizon.

The heel face 42 and toe face 44 are uplifted from the plane 49 by approximately 3/16". The sole 48 at the heel 16 and toe 18 ends extends downward 1" and ¾", respectively, toward the central portion of the sole 48. As can be seen in FIG. 6, the central portion of the sole 48 includes the area below the cavities 26 and the central strut 30. The sole 48 extends in width from the face 14 to approximately ⅛" from the back edge 46. The back edge 46 is also uplifted approximately 1/10" from the plane 49.

The maximum height of the head 10, corresponding to the maximum height of the face 14, is 1". The length of the head 10, measured from the heel face 42 to the toe face 44 is 5". Referring again to FIG. 4, the length contributions to this overall length by the struts 28, 30, and 32 are 1⅛", ¾", and 1", respectively. The contributions by the proximal and distal cavities 26 are 1" and 1⅛", respectively. The distance between the front face 14 and the back face 34 is ⅛", and the maximum width of the head 10, measured below the central strut 30, is 1¾".

Figure 7:
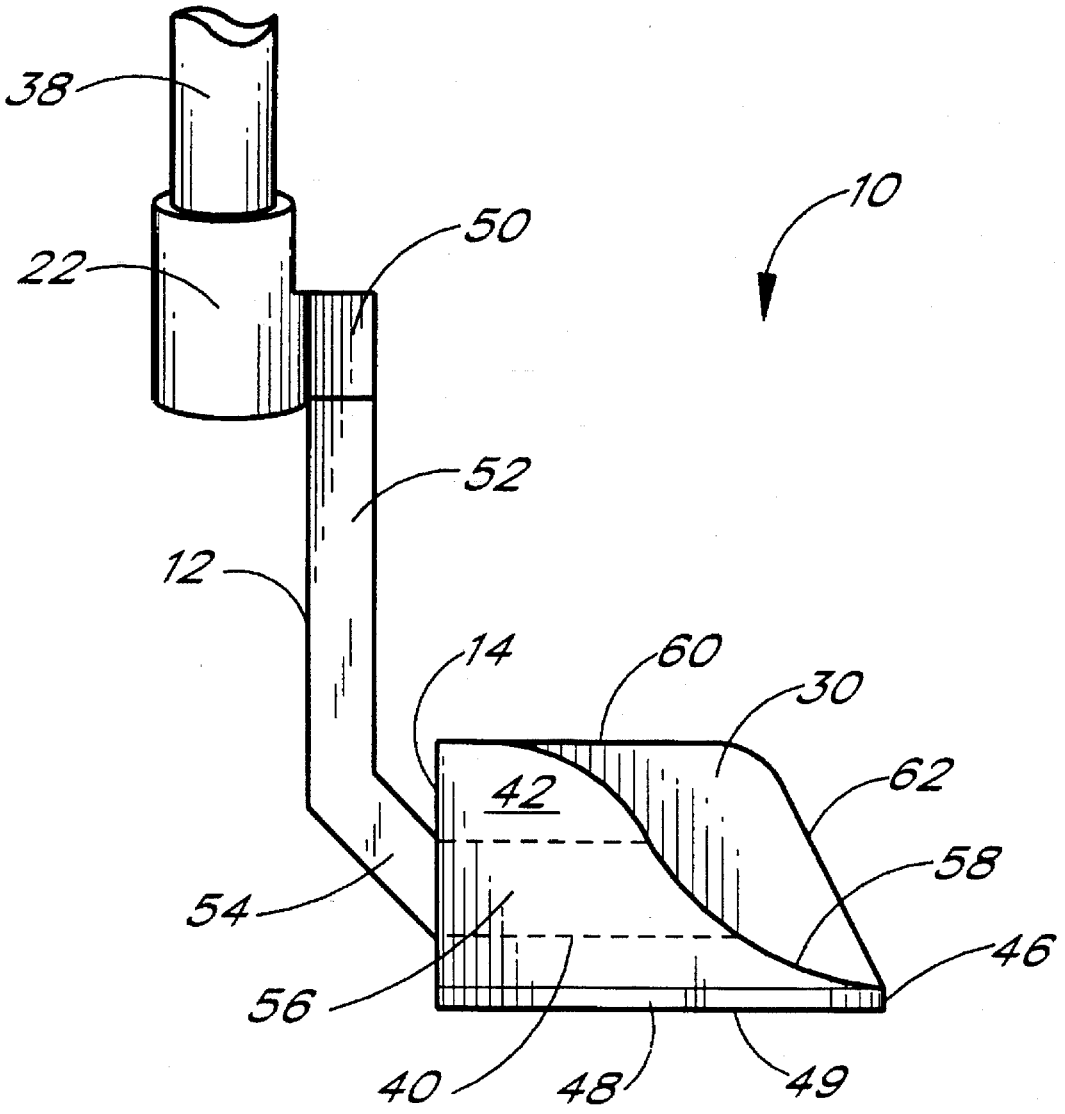
FIG. 7 is a side elevational view of the toe or distal end of the preferred embodiment, which is the mirror image of the heel or proximal end.

As indicated in FIG. 6, the preferred lie for a putter is substantially 90 degrees. In the instant case, this lie is 74 degrees, but may be more or less in alternate embodiments. As indicated in FIG. 7, the head 10 for the preferred embodiment is nearly straightfaced with a loft of three degrees. The face 14 may be of slightly more or less loft in another putter embodiment, or of substantially greater loft for other club types.

Referring in detail to FIG. 7, it can be seen that the two end struts 28 and 32 have generally S-shaped upper faces 58. The central strut 30 has an upper face 60 which is parallel to the plane 49, and has a back face 62 that is at a 30 degree angle to the vertical. The approximate width of the upper face 60 of the central strut 30 is 1¼".

As clearly shown in FIG. 7, the socket 22 is located on the uppermost end of the hosel 12. The hosel 12 is angled below the socket 22 to form a segment 50 approximately ½" long which is parallel to the horizon and extends toward the face 14 of the head 10. The main body 52 of the hosel 12 extends vertically downward approximately 1¼", parallel to the face 14. The lower portion 54 of the hosel 12 is at a 45 degree angle and extends downward approximately 3/8" until the hosel 12 is in communication with the face 14. In alternate embodiments this angle may be varied to accommodate different hosel dimensions and club head lofts corresponding to different club types.

As shown in phantom in FIG. 7, an arm 56 formed by the lowest segment of the hosel 12 proceeds laterally through the aperture 40 and extends through the width of the proximal strut 28. The longitudinal axis of the arm 56, and the centerline of the aperture 40, are located ½" from the face 42. Alternate embodiments may limit the length of this arm 56 and the aperture 40, so that the end of the hosel 12 is not exposed but instead contained within the head 10.

As discussed previously in great detail, the arm 56 serves to further reduce the torsional force transmitted to the shaft 38, by opposing the moment imparted by impact with the ball 36. Although, the front to back configuration with the hosel 12 located closer to the sweet spot 20 provides by itself a reduction in the torsion transmitted to the shaft 38. Thus, the shaft 38 is spared material stress, and better control results from reduced twisting of the club head 10.

The shapes and dimensions of the hosel 12, including its socket 22, may be modified by those skilled in the art, while retaining the front to back configuration of the present invention. It is to be understood that the embodiments described herein are merely illustrative of the present invention. Changes and modifications may be made by those skilled in the art without departure from the spirit and scope of the invention, as defined in the appended claims.

What is claimed is:

1. A head for a golf club, comprising:

a face formed on a front of said head;

a heel formed on a proximal end of said head and a toe formed on a distal end of said head;

a top, and a sole on a bottom of said head; and a hosel having an upper end comprising a socket for fixedly receiving a shaft of said club, said socket being longitudinally aligned in a plane spaced approximately 0.84 inch in front of and parallel to said face, said hosel having a lower end comprising a lateral connecting member for mounting said hosel into said face approximately at right angles thereto, said lower end vertically located about 0.25 inch above a plane formed by said sole, whereby said hosel is in a front-to-back configuration with said face and extending generally through said heel portion, said face and said heel extending proximally around said hosel such that said hosel is not contiguous with said proximal end of said head.

2. A method of constructing a golf club, comprising inserting a tubular shaft into a cylindrically shaped socket on a first end of a hosel, and inserting a second end of said hosel into an aperture on a front face of a club head, wherein said hosel extends laterally from front to back substantially through a heel portion on a proximal end of said head, said face and said heel extend proximally around said aperture, said shaft and said hosel form a front-to-back relationship with said head.

3. The method of claim 2, wherein said insertion of said hosel is through said aperture extending from said face through said heel portion to a back of said head.

4. The method of claim 3, wherein said insertion of said hosel is through said aperture formed at approximately a right angle to said face.

5. A head for a golf club, comprising:

a face formed on a front of said head;

a heel formed on a proximal end and a toe formed on a distal end of said head;

a top, and a sole formed on a bottom of said head; and a hosel having an upper end comprising a socket for fixedly receiving a shaft of said club, said hosel in a front-to-back configuration with said face, said hosel having a lower end comprising a connecting member extending laterally from front to back substantially through said heel.

6. The head of claim 5, wherein said lower end of said hosel is vertically located about 0.25 inch above a plane formed by said sole.

7. The head of claim 5, wherein said member forms approximately a 90 degree angle to said face.

8. The head of claim 5, wherein a back portion of said head located behind said face and above said sole is formed by at least one cavity between at least two struts, a proximal strut forming said heel and a distal strut forming said toe.

9. The head of claim 5, wherein said hosel is formed of metal.

10. The head of claim 5, wherein said head is formed of metal.

11. The head of claim 5, wherein a longitudinal axis passing through a lower portion of said hosel positioned in front of said face forms an angle greater than zero degrees with said face.

12. The head of claim 5, wherein a notch is centrally located on said top and extends laterally from a top edge of said face.

13. The head of claim 5, wherein said sole is of a convex shape with said proximal and distal ends uplifted from a central area of said sole.

* * * * *